US009887494B2

(12) United States Patent
Leroyer et al.

(10) Patent No.: US 9,887,494 B2
(45) Date of Patent: Feb. 6, 2018

(54) LOCKING AND UNLOCKING SYSTEM

(71) Applicant: SOURIAU, Versailles (FR)

(72) Inventors: Serge Leroyer, Le Mans (FR); François Will, Le Mans (FR)

(73) Assignee: SOURIAU, Versailles (FR)

( * ) Notice: Subject to any disclaimer, the term of this patent is extended or adjusted under 35 U.S.C. 154(b) by 0 days.

(21) Appl. No.: 15/611,697

(22) Filed: Jun. 1, 2017

(65) Prior Publication Data

US 2017/0352986 A1 Dec. 7, 2017

(30) Foreign Application Priority Data

Jun. 2, 2016 (FR) ..... 16 55043

(51) Int. Cl.

| | |
|---|---|
| ***H01R 4/38*** | (2006.01) |
| ***H01R 13/639*** | (2006.01) |
| ***H01R 13/627*** | (2006.01) |
| ***H01R 13/622*** | (2006.01) |
| ***H01R 13/533*** | (2006.01) |

(52) U.S. Cl.

CPC ..... *H01R 13/639* (2013.01); *H01R 13/533* (2013.01); *H01R 13/622* (2013.01); *H01R 13/6275* (2013.01)

(58) Field of Classification Search

CPC ..... H01R 13/622
USPC ..... 439/321
See application file for complete search history.

(56) References Cited

U.S. PATENT DOCUMENTS

| | | | | |
|---|---|---|---|---|
| 4,703,988 | A * | 11/1987 | Raux | H01R 13/622 439/321 |
| 5,399,096 | A * | 3/1995 | Quillet | H01R 13/622 439/312 |
| 7,806,621 | B2 * | 10/2010 | Leroyer | H01R 13/622 403/299 |
| 8,550,742 | B2 * | 10/2013 | Leroyer | H01R 13/623 403/342 |
| 9,112,307 | B2 * | 8/2015 | Leroyer | H01R 13/639 |
| 2010/0099290 | A1 * | 4/2010 | Gastineau | H01R 13/622 439/321 |
| 2011/0318098 | A1 * | 12/2011 | Gloaguen | F16L 19/005 403/350 |

* cited by examiner

*Primary Examiner* — Neil Abrams
(74) *Attorney, Agent, or Firm* — Im IP Law; C. Andrew Im

(57) ABSTRACT

A secure locking and unlocking system includes a plug body that is cylindrical in shape, a locking ring and a notched washer. One face of the notched washer is positioned on the locking surface of the locking ring. The system further includes a holding pin that locks the position of a locking element and an upper ring mounted on the locking ring. The locking ring includes a ramp-shaped groove with a linear part, a rising ramp and a descending ramp. A ramp spring is configured so that the locking or unlocking movement of the upper ring is mobile and the locking ring is fixed. The upper ring includes a hole in which a lug is placed. The end of the lug cooperates with the ramp-shaped groove of the locking ring that guides the upper ring in relation to the locking ring.

9 Claims, 7 Drawing Sheets

LOCKING AND UNLOCKING SYSTEM

RELATED APPLICATIONS

This application claims priority from French Patent Application No. 16 55043 filed Jun. 2, 2016, which is incorporated herein by reference in its entirety

TECHNICAL FIELD OF THE INVENTION

This invention relates to a secure locking system that locks the system in place regardless of the vibrations of the exterior environment.

The invention also relates to an electrical connector and a connector assembly comprising such a locking system.

The invention can be applied in all fields where a housing needs to be locked onto another component. In particular, it can be applied in the area of connectors, and particularly connectors for the aeronautics or automotive industries, where connectors are subjected to high vibrations.

BACKGROUND OF THE INVENTION

In the area of connectors, a "connector assembly" is an assembly of two connecting elements (for example a male connecting element and a female connecting element) assembled to each other to make an electrical connection. Each of the connecting elements comprises one or more electrical contacts (male or female) suitable for assembly with the complementary electrical contacts of the other connecting element.

In some applications, particularly in the fields of aeronautics or automotive connectors, high environmental vibrations make the connecting elements move in relation to each other. These movements can lead to a loss of electrical bonding between said connecting elements within the same connector assembly.

In order to prevent the movement of a connecting element in relation to the other, fitting each connector assembly with a locking system for locking the link between the two connecting elements and thus preventing unintentional disconnection is known. Such a locking system must make it possible to maintain the connection, even when the connector assembly is subjected to vibrations.

To that end, the installation of a locking system around one of the connecting elements in order to lock each connecting element in relation to the other connecting element of the same connector assembly is known. Different locking systems are currently in existence. The best known system consists in a generally cylindrical locking ring mounted at the end of one of the connecting elements in order to hold the two connecting elements assembled. Said locking ring is generally a short hollow cylinder, henceforth called a ring, fitted with a first holding means intended to hold the ring free to rotate around a first connecting element and a second holding means intended to hold the ring on the second connecting element of the connector assembly.

Locking rings include locking rings where the second holding means is a thread for screwing said ring on the connecting elements, machined on the inner wall of the ring.

That thread is not always sufficient for maintaining the connection during vibrations, and so there are locking rings where the second holding means is supplemented by a series of notches intended to fit around a locking element. Those notches are also made in the inner wall of the ring, which has a series of notches intended to fit around a locking element. The locking element may then be a simple locking pin or a device that predominantly has a ball and a spring. In that second alternative, the locking element generally comprises a hole that opens out at the surface of the connecting element and forms a transverse recess. The locking element also comprises a spring placed transversally in the opening hole, that is to say placed perpendicular to the direction of the electrical contacts of the connecting element. That locking element additionally comprises a ball placed above the spring so as to be partly in the recess. That ball is positioned so as to be partly in the recess when the spring is relaxed and totally in the recess when the spring is compressed. In this alternative, the locking ring is mounted at the end of the connecting element so as to be able to cover the recess.

When the system is locked, the operator makes the locking ring rotate around the connecting element. The inner wall of the locking ring slides, notch after notch, around the end of the connecting element, and thus the locking element. Thus, the notched inner wall of the locking ring makes the ball move in its recess. That movement is brought about by the notches of the locking ring. That is because each notch has an asymmetrical tooth that is shaped substantially like a right-angled triangle. Each notch thus has a low lower side, and a higher upper side. The height of the upper side is substantially equal to the height of the part of the ball that projects out of the recess. Thus, when the locking ring is rotating, the lower side of the notches presses against the ball, compressing the spring. The ball is then entirely housed in the recess and does not project out of said recess. The locking ring continues to slide, and so the upper side of the notches is located opposite the ball, which can then move out of the recess in part as the spring relaxes. When the ball is partly out of its recess, it is locked in the notch of the locking ring, thus locking the connector assembly.

However, in extreme conditions, particularly with high vibrations or jolts, the spring can sometimes be compressed involuntarily, moving the ball into the recess, which allows the notches of the locking ring to slide and thus unlock said ring. Such extreme conditions occur, for example, in the field of automobiles, when a vehicle goes over a pothole or any other cavity in the road, or in the field of aeronautics, in air pockets or during landing impacts.

OBJECT AND SUMMARY OF THE INVENTION

This invention is aimed at remedying those drawbacks.

To that end, in a first aspect, this invention relates to a secure locking and unlocking system comprising:

- a plug body that is cylindrical in shape, which plug body comprises a threaded part on the outer wall,
- a locking ring with a thread on the inside adapted to be mounted on the plug body, wherein said locking ring comprises at least one hole extending along a line parallel to the longitudinal axis of the locking ring and opening onto a locking surface, wherein said locking ring is configured to lock the locking system in one direction of rotation of the locking ring and unlock the locking system in the other direction of rotation of the locking ring,
- a notched washer, one side of which is positioned on the locking surface of the locking ring,
- a holding pin that locks the position of a locking element and is inserted in the hole extending beyond the locking surface,
- an upper ring mounted on the locking ring, wherein the upper ring comprises a contact surface that is adapted to press against the other face of the notched washer, wherein said upper ring comprises a lever adapted to unlock the locking element in the direction of rotation of the locking ring, the locking element, such as a latch, mounted on the holding pin to lock the position of the locking element, wherein said locking element comprises a flexible part adapted to fit between two notches of the notched washer, remarkable in that:

the locking ring comprises a groove, said groove is shaped like a ramp with a linear part, and then a rising ramp and a descending ramp, a ramp spring (39) configured so that the locking or unlocking movement of the upper ring (28) is mobile and the locking ring (23) is fixed, the upper ring comprises a hole in which a lug is placed, and the end of the lug cooperates with the ramp-shaped groove of the locking ring that guides the upper ring in relation to the locking ring.

Thanks to those arrangements, during extreme conditions, particularly high vibrations or jolts, the locking ring remains in place. That configuration prevents the locking element from passing several notches and prevents the unlocking of the ring. The number of parts is smaller than in the existing system, which reduces manufacturing costs.

The system makes it possible to lock the plug and prevent unwanted unlocking due to vibrations or pulling on the plug body. The manual rotation of the upper ring enables the user to unlock or lock it depending on the rotation direction.

That latch system makes it easy to manage the choice of locking or unlocking. Locking is by turning the upper ring clockwise. Unlocking is by turning the upper ring counter-clockwise.

Thus, the operator feels the force applied on the locking ring and can sense the end of locking. In some environments, feeling the tightening and thus locking makes it possible to lock the system without seeing it.

Further, the plug remains within the size recommended by standard MIL-C 38999 SIII.

The invention can be implemented advantageously in the embodiments and alternatives described below, which may be considered individually or in any technically operative combination.

In one embodiment, the stiffness of the ramp spring applies a predetermined limit value for locking or unlocking the locking ring.

The spring is compressed and adds torque to locking and unlocking. That torque is greater than simple locking or unlocking.

In one embodiment, the predetermined limit value is above 0.2 Nm.

In one embodiment, the locking ring comprises a first visual mark and the upper ring comprises a second visual mark; when the first visual mark and second visual mark are lined up, the locking system is locked.

Thus the lining up or otherwise of the visual marks provides visual indication of whether or not the system is locked.

In one embodiment, a return spring is positioned in a recess of the upper ring between a guide pin and a support of the recess of the upper ring, wherein said spring is positioned in a circular manner in relation to the upper ring.

In one embodiment, the closing ring is held in place by a retaining circlip inside the upper ring.

In one embodiment, each notch of the notched washer has a vertical slope to block unlocking and an oblique slope to obtain a ratchet sound upon locking.

In one embodiment, the upper ring comprises an opening that lets through the plug body.

BRIEF DESCRIPTION OF FIGURES

Other advantages, aims and characteristics of this invention will become apparent from the description below, which is explanatory and not limitative in any way, by reference to the drawings attached, wherein.

DESCRIPTION OF EXEMPLARY EMBODIMENTS OF THE INVENTION

Figure 1:
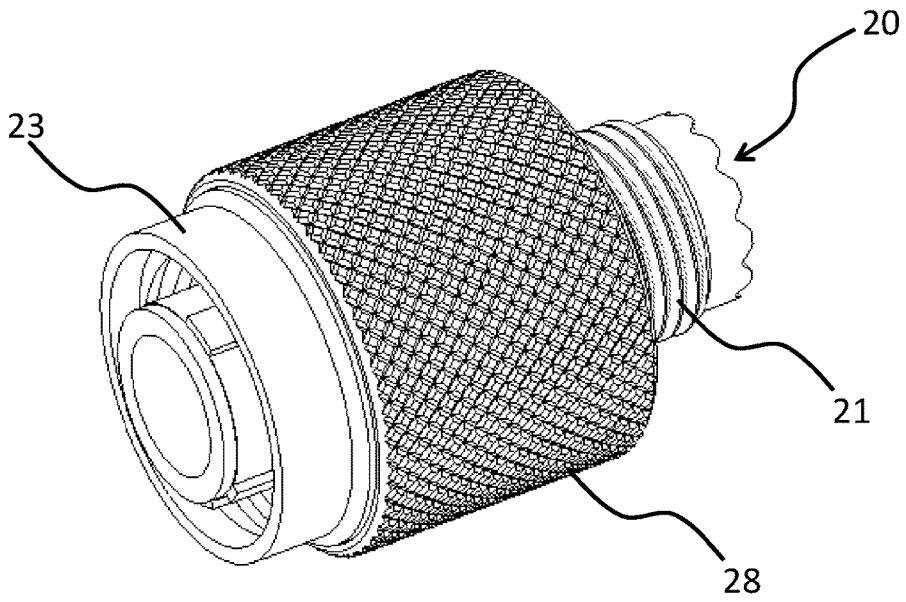
FIG. 1 is a perspective view of a secure locking system in a particular embodiment of the system according to this invention.

FIG. 1 is a perspective view of a secure locking system according to a particular exemplary embodiment. The plug body 20, the upper ring 28 and the locking ring 23 are visible.

The plug body 20 has a threaded part 21 on the outer wall.

Figure 2:
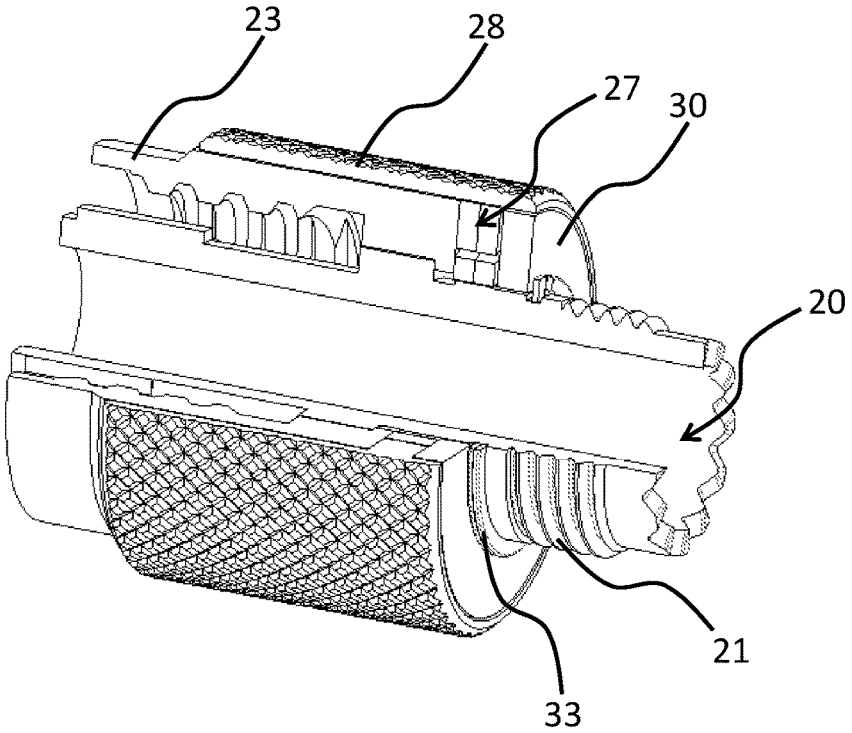
FIG. 2 represents a quarter-section perspective view of the locking system in FIG. 1.

FIG. 2 represents a quarter-section perspective view of the locking system in FIG. 1. The plug body 20, the upper ring 28 and the locking ring 23 are also visible in this figure.

The closing ring 30 and the retaining circlip 33 (elastic ring) are also visible.

The closing ring 30 closes the locking system and prevents dust from entering inside the locking system. The retaining circlip 33 holds the closing ring 30 in its position. The closing ring 30 is positioned adjacent to the locking ring 23. That is to say the closing ring 30 is set flat against the locking ring 23. These two rings are concentric.

The upper ring 28 comprises an opening, referenced 34 (visible in FIG. 3) that lets through the plug body 20. This opening is cylindrical and circular.

Figure 3:
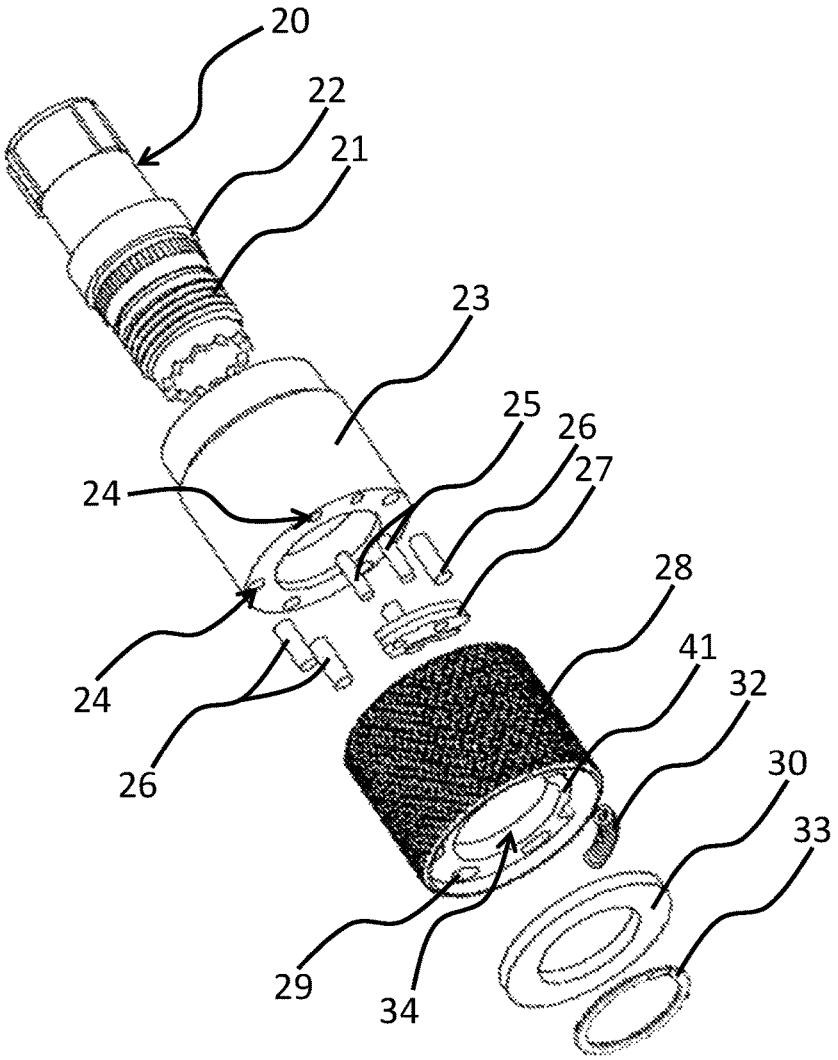
FIG. 3 is an exploded view of the secure locking system of FIG. 1.

FIG. 3 is an exploded view of the secure locking system of FIG. 1.

A plug body 20 that is cylindrical in shape can be seen. The plug body 20 comprises a threaded part 21 on the outer wall and another part comprising a series of notches 22. The series of notches 22 represents a notched ring.

In one embodiment, the notched part 22 is added to the plug body 20 using a molding or heading process.

A locking ring 23 that is threaded on the inside and suitable for being mounted on the plug body 20 is visible. The locking ring 23 comprises at least two holes 24. Each hole 24 extends along a line parallel to the longitudinal axis of the locking ring 23 opening onto a locking surface.

The locking ring 23 is configured to lock the locking system in a direction of rotation of the locking ring 23 and to unlock the locking system in the other direction of rotation of the locking ring 23.

In this exemplary embodiment, there are two holding pins 25 to lock the position of a locking element 27. The two holding pins 25 are inserted in two adjacent holes 24. These holes 24 extend beyond the locking surface.

In this exemplary embodiment, there are four guide pins inserted in other holes 24. These holes 24 also extend beyond the locking surface.

The upper ring 28 is mounted on the locking ring 23. The upper ring 28 is placed on top of the locking ring 23.

On that plug body 20, the threaded locking ring 23 is mounted before the notched ring.

The upper ring 28 comprises a contact surface suitable for pressing against the locking surface of the locking ring 23.

The contact surface comprises four oblong through holes 29 adapted to receive the guide pin 26. The shape of the oblong holes allows a degree of freedom and leaves room for the locking ring 23 to move slightly in a concentric manner in relation to the plug body 20. The oblong holes are located so as to follow the rotation of the locking ring 23.

The upper ring 28 comprises a flexible part 31 that is adapted to unlock the locking element in the direction of rotation of the locking ring 23. The flexible part 31 is an arm with a circular shape located inside the upper ring 28, which follows the circular shape of the upper ring 28.

The locking element 27, such as a latch, is mounted on the two retaining pins 25 that block the position of the locking element 27. The locking element 27, henceforth called latch, comprises a flexible part adapted to fit between two notches of the plug body 20. The part is flexible thanks to the elasticity of the material.

The use of a latch blocks the unlocking of the plug body 20 brought on by parasite vibrations. The latch is manually disengaged by rotating the upper ring 28 that is on top of the locking ring 23 containing the thread engaged with the thread of the plug body 20.

In the stable position, the latch is pressed against the notches, which blocks any involuntary unlocking.

In order to unlock the connector, the operator must turn the upper ring 28 by about 10° in the counterclockwise direction.

As a result, the flexible part of the upper ring 28 (or arm) located at the perimeter of the notches lifts the latch. The connector is thus unlocked.

The upper ring 28 is set against four pins inserted in the locking ring 23, and the user only needs to continue turning in the counterclockwise direction to unlock the connector entirely. A return to a stable position with a latch engaged with the notches of the plug body 20 is made possible thanks to a return spring 32 placed in the tangential position of the locking ring 23.

The return spring 32 is placed in a housing of the upper ring 28 between a guiding pin 27 and a support of the recess of the upper ring 28. The return spring 32 is placed in a circular manner in relation to the upper ring 28.

Figure 4:
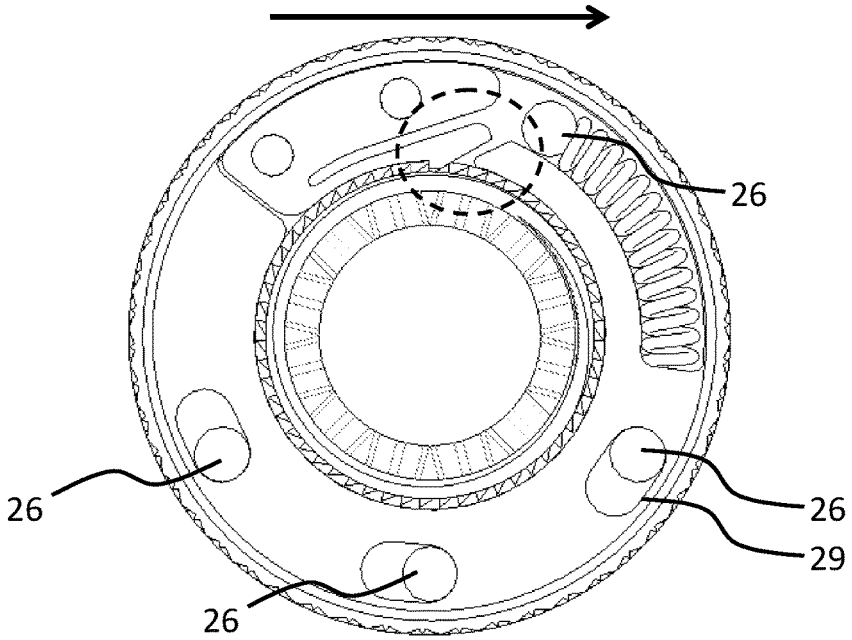
FIG. 4 is a cross-sectional view along a plane perpendicular to the longitudinal axis of the locking system of FIG. 1 in the locked position.

FIG. 4 is a cross-sectional view along a plane perpendicular to the longitudinal axis of the locking system of FIG. 1 in the locked position.

In that configuration, the guide pins 26 are positioned to the right of the oblong through holes 29.

The arrow shows the locking direction. The dotted circle shows the locking location.

Figure 5:
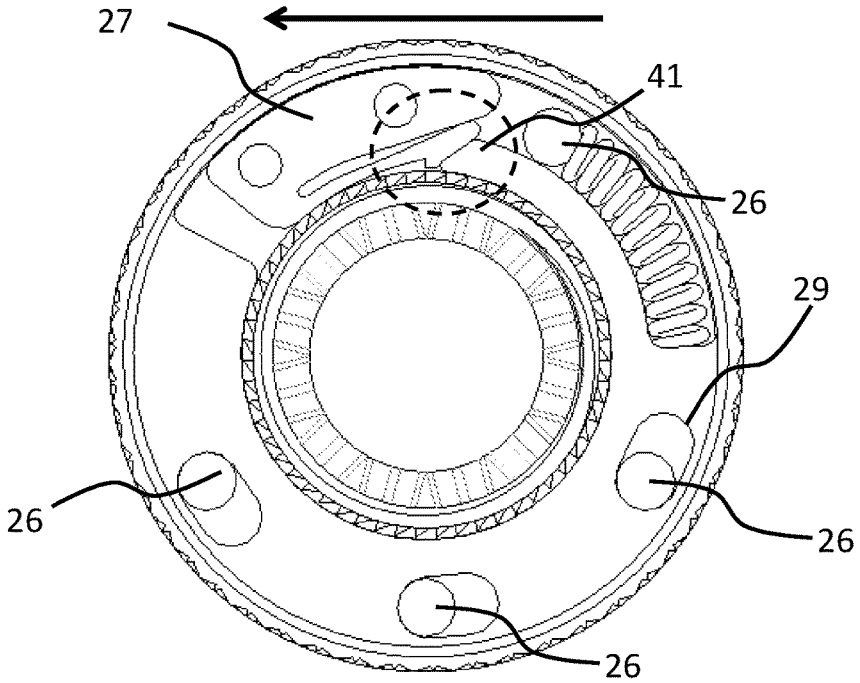
FIG. 5 is a cross-sectional view along a plane perpendicular to the longitudinal axis of the locking system of FIG. 1 in the unlocked position.

FIG. 5 is a cross-sectional view along a plane perpendicular to the longitudinal axis of the locking system of FIG. 1 in the unlocked position.

In that configuration, the guide pins 26 are positioned to the left of the oblong through holes 29.

The flexible part 31 is adapted to unlock the latch in the direction of rotation of the locking ring 23. The flexible part is used to lift the latch.

The arrow shows the unlocking direction. The dotted circle shows the unlocking location.

Figure 6:
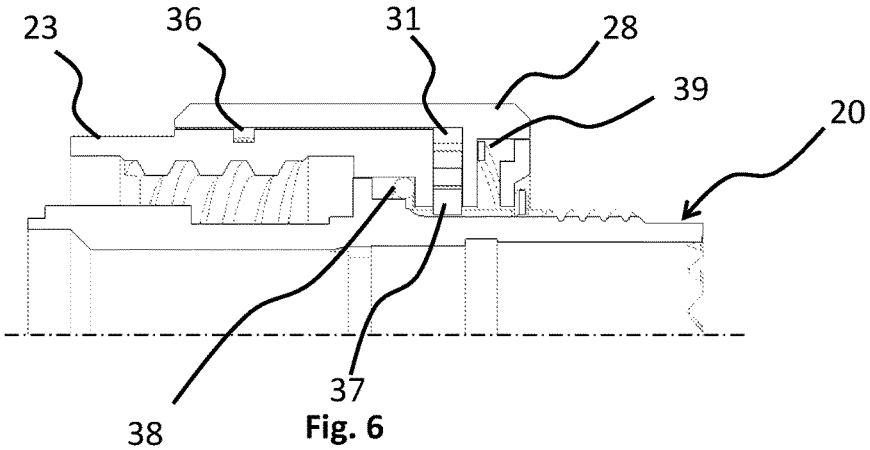
FIGS. 6-9 represent another embodiment with a ramp.

FIG. 6 shows another embodiment with a ramp. This figure shows the plug body 20, the locking ring 23, the upper ring 28, the flexible part 31 and the notched washer.

In an unillustrated alternative, there is only a ramp spring, referenced 39 in the figure, which makes it possible to make the upper ring 28 mobile during the locking or unlocking phase: the locking ring 23 is fixed and the upper ring 28 is mobile via the ramp spring 39.

In the illustrated alternative, a first ramp spring 38 is placed between the plug body 20 and the locking ring 23. A second ramp spring 39 is placed between the plug body 20 and the upper ring 28.

The stiffness of the first spring and second spring applies a predetermined limit value for locking or unlocking the locking ring 23. Thus, the operator feels the force applied on the locking ring and can sense the end of locking. In some environments, feeling the tightening and thus locking makes it possible to lock the system without seeing it.

Figure 7:
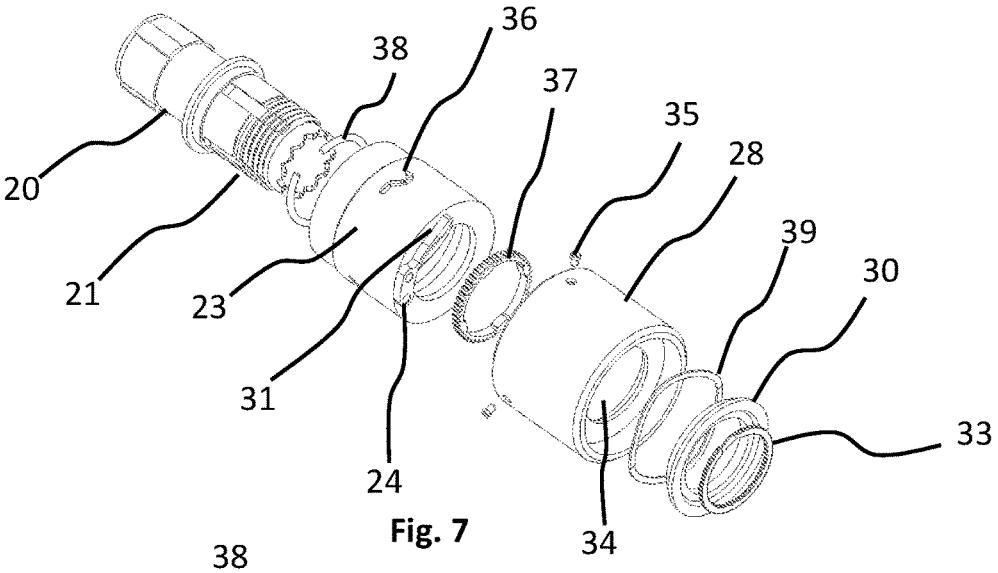

FIG. 7 is an exploded view of the secure locking system of FIG. 6.

A plug body 20 that is cylindrical in shape can be seen. The plug body 20 has a threaded part 21 on the outer wall.

A notched washer 37, one side of which is positioned on the locking surface of the locking ring, can be seen.

A locking ring 23 that is threaded on the inside and adapted to be mounted on the plug body 20 is visible. The locking ring 23 comprises at least one hole 24. The hole 24 extends along a line parallel to the longitudinal axis of the locking ring 23 opening onto a locking surface. In this embodiment, there are two holes 24.

The locking ring 23 is configured to lock the locking system in a direction of rotation of the locking ring 23 and to unlock the locking system in the other direction of rotation of the locking ring 23.

In this exemplary embodiment, there are two holding pins 25 to lock the position of a locking element 27. The two holding pins 25 are inserted in two adjacent holes 24. These holes 24 extend beyond the locking surface.

The upper ring 28 is mounted on the locking ring 23. The upper ring 28 is placed on top of the locking ring 23.

On that plug body 20, the threaded locking ring 23 is mounted before the notched ring 37.

The upper ring 28 comprises a contact surface 42, shown in the next figure, adapted to press against the other side of the notched washer 37.

The contact surface 42 comprises a lever 41.

The closing ring 30, the opening 34 and the circlip have been described above.

The locking ring 23 moves in a concentric manner in relation to the plug body 20.

The locking ring 23 comprises a through hole, and said hole is shaped like a ramp 36 with a linear part, and then a rising ramp and a descending ramp.

The upper ring 28 comprises a through hole in which a lug 35 is placed, and the end of the lug 35 cooperates with the ramp-shaped through hole of the locking ring 23 to guide the upper ring 28 in relation to the locking ring 23.

The upper ring 28 comprises a flexible part 31 that is adapted to unlock the locking element in the direction of rotation of the locking ring 23. The flexible part 31 is an arm with a circular shape located inside the upper ring 28, which follows the circular shape of the upper ring 28.

The locking element 27, such as a latch, is mounted on the two retaining pins 25 that block the position of the locking element 27. The locking element 27, henceforth called latch, comprises a flexible part adapted to fit between two notches of the plug body 20. The part is flexible thanks to the elasticity of the material.

The use of a latch blocks the unlocking of the plug body 20 brought on by parasite vibrations. The latch is disengaged by the lever 41 (shown in the next figure), manually by rotating the upper ring 28 that is on top of the locking ring 23 containing the thread engaged with the thread of the plug body 20.

In the stable position, the latch is pressed against the notches, which blocks any involuntary unlocking.

In order to unlock the connector, the operator must turn the upper ring 28 by about 10° in the counterclockwise direction.

As a result, the flexible part of the upper ring 28 (or arm) located at the perimeter of the notches lifts the latch. The connector is thus unlocked. The user only has to continue turning in the counterclockwise direction to unlock the connector entirely.

The working of the first ramp spring 38 and the second ramp spring 39 has been explained above.

Figure 8:
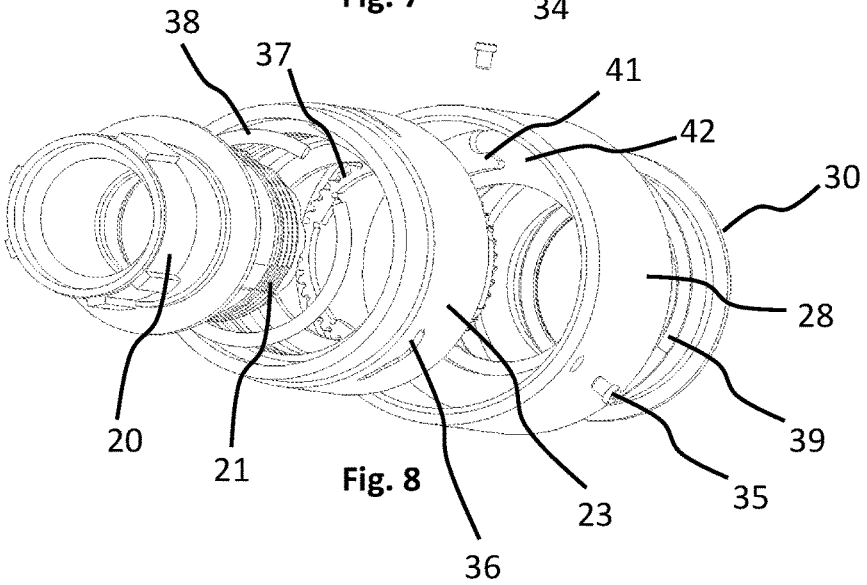

FIG. 8 shows some of the elements of FIG. 7 once again. This figure shows the contact surface 42 and the lever 41, as described above.

Figure 9:
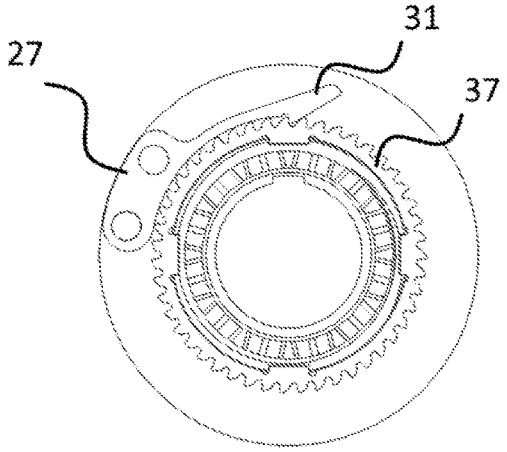

FIG. 9 shows the locking element 27, the flexible part 31 and the notched washer 37.

FIGS. 10 to 24 represent locking of the embodiment shown in FIGS. 6 to 9. These figures show the locking ring 23, the flexible part 31, the upper ring 28, the first ramp spring 38, the second ramp spring 39, the plug body 20, the notched washer 37, the lug 35, the ramp 36, the notch of the flexible part 40 and the lever 41.

Figure 10:
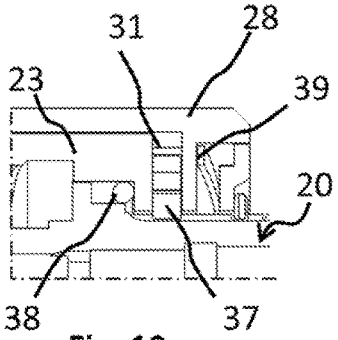
FIGS. 10-24 represent locking of the embodiment shown in FIGS. 6-9.
Figure 11:
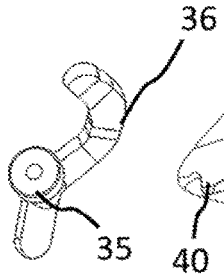
Figure 12:
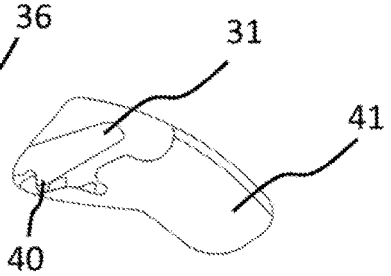

FIGS. 10 to 12 show the plug body 20 in the free state. The locking ring 23 and the upper ring 28 can only turn clockwise in relation to the plug body 20. That is because of the particular profile of the notches of the notched washer 37 and the notch of the flexible part 40.

Figure 13:
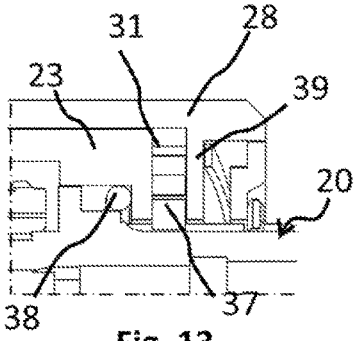
Figure 14:
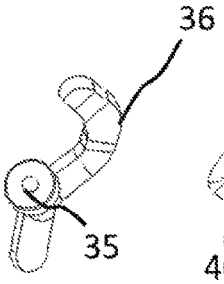
Figure 15:
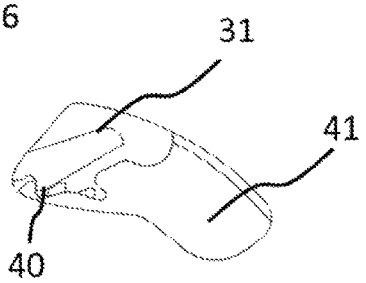

FIGS. 13 to 15 show another position.

During screwing onto the plug body 20: first, when the tightening torque has not reached a predetermined limit value imposed by the standard (Cv min), the locking ring 23 and the upper ring 28 are integral with each other, because of the position of the lug 35 along the profile of the ramp 36. Rotating the upper ring 28 makes the plug body 20 rotate.

Figure 16:
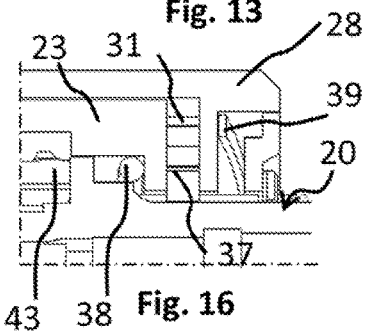
Figure 17:
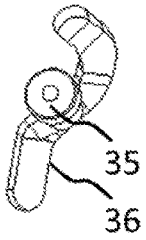
Figure 18:
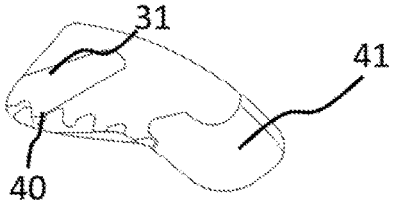

FIGS. 16 to 18 show another position.

While screwing onto the base socket: when the end of the socket 43 comes into contact with the plug body 20. The tightening torque stiffens without reaching Cv min, the rotation of the upper ring 28 separates from that of the locking ring 23. The locking ring 23 continues to be screwed to the socket 43, and the first ramp spring 38 is compressed. The upper ring 28 moves back in relation to the locking ring 23.

Figure 19:
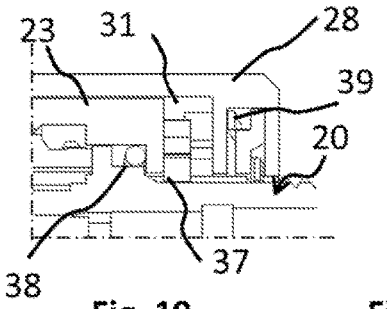
Figure 20:
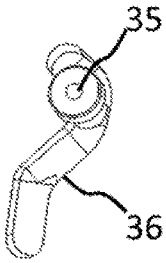
Figure 21:
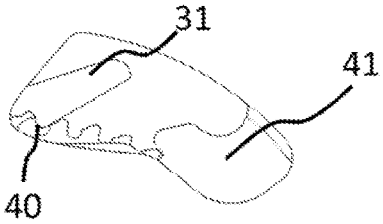

FIGS. 19 to 21 show another position.

When the locking ring 23 reaches the extreme position with the plug body 20, the tightening torque stiffens to exceed Cv min. Then the locking ring 23 ceases to turn and the upper ring 28 continues to turn alone, the lug 35 passes the top of the ramp 36 (peak tightening torque) and moves the upper ring 28 back furthest from the locking ring 23.

Figure 22:
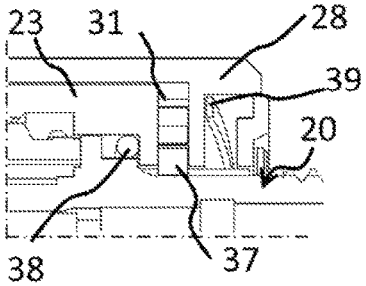
Figure 23:
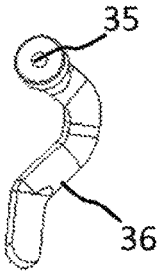
Figure 24:
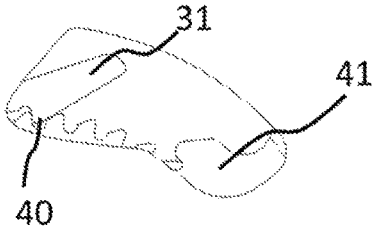

FIGS. 22 to 24 show another position.

The tightening torque of the upper ring 28 then decreases, till it increases again when the tightening ring 23 and the upper ring 28 are integral once again. The operator stops turning the upper ring 28. The plug body 20 is locked with socket 43. The stable position of the lug 35 in the hollow of the ramp 36 by the thrust of the second ramp spring 39 on the upper ring 28 guarantees the locking of the plug body 20. Unlocking the plug body 20 makes it necessary for the operator to take manual action.

Figure 25:
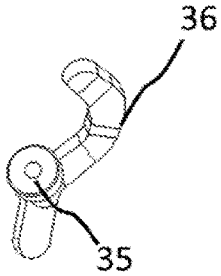
FIGS. 25-32 represent unlocking of the embodiment shown in FIGS. 6-9.
Figure 26:
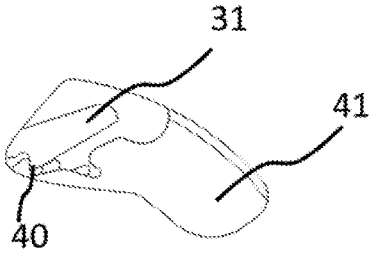

FIGS. 25 and 26 show another position.

To unlock, the operator must apply torque in the counterclockwise direction in a value above the minimum unlocking torque imposed by the standard. The upper ring 28 separates from the locking ring 23, the lug 35 then moves down the ramp 36 following its profile. The locking ring 23 remains locked on the socket 43 because the flexible part 31 is not lifted.

Figure 27:
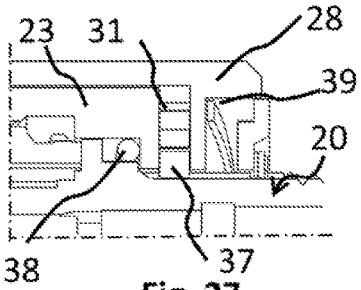
Figure 28:
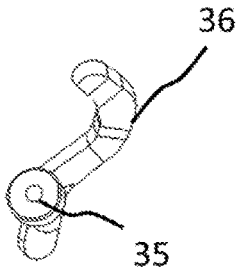
Figure 29:
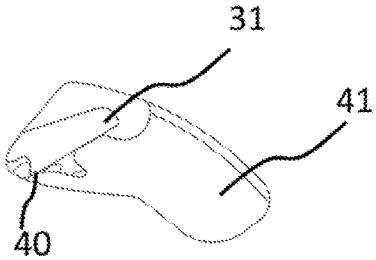

FIGS. 27 to 29 show another position.

The lever 41 ultimately reaches the extreme position with the flexible part 31. The first ramp spring 38 is then at maximum compression.

Figure 30:
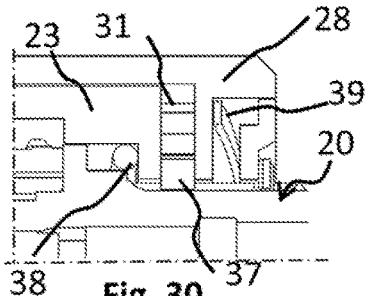
Figure 31:
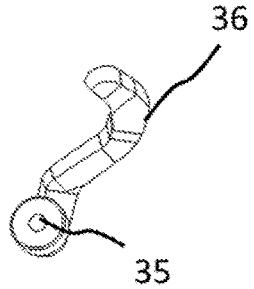
Figure 32:
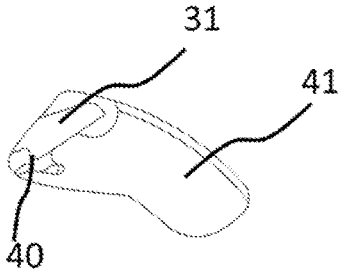

FIGS. 30 to 32 show another position.

The operator continues to turn the upper ring 28 to unlock the plug body 20. The flexible part 31 is then lifted. The upper ring 28 becomes integral with the locking ring 23 once again when the lug 35 reaches the extreme position at the bottom of the ramp 36. The socket 43 is then unlocked.

Figure 34:
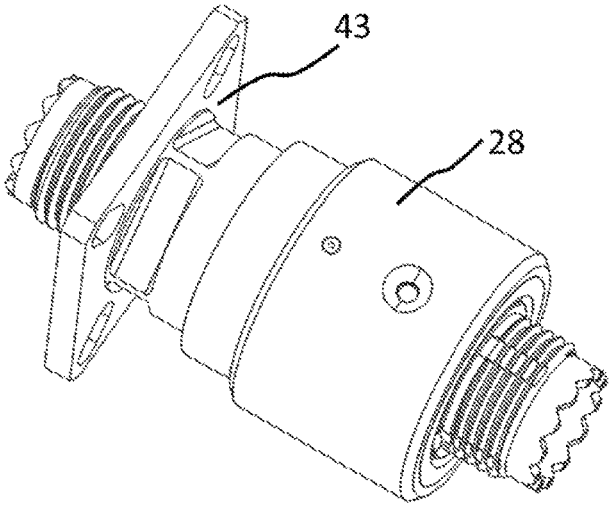
FIGS. 33-35 represent another embodiment with a visual mark.
Figure 33:
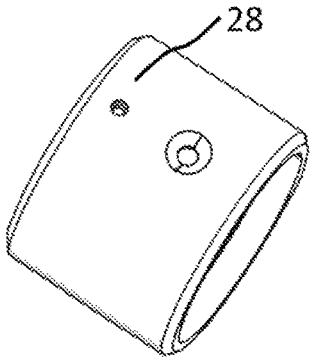
Figure 35:
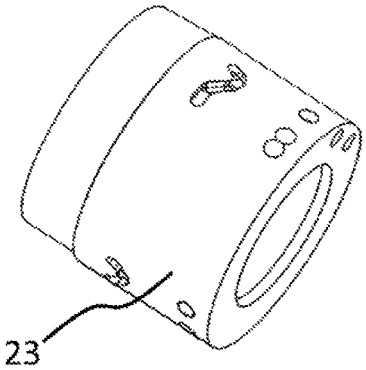

FIGS. 33, 34 and 35 represent another embodiment with a visual mark.

These figures show visual indication of locking and unlocking, achieved by the lining up or otherwise of the visual marks placed opposite each other between the locking ring 23 and the upper ring 28. These visual marks are represented by circles and are colored. There are three cases of correspondence:

- in the first case, the mark is fully red, showing that the plug is securely locked;
- in the second case, the mark is a blue circle surrounded by a red collar, showing that the plug is not locked;
- in the third case, the mark is a green circle surrounded by a red collar, showing that the plug is being unlocked.

In an alternative that has not been illustrated, the flexible part comprises a spring that forces the flexible part to move by blocking or not the notches of the notched ring 37 or the notches of the plug body 20.

LIST OF PARTS

20 plug body
21 threaded part
22 notches
23 locking ring
24 holes
25 retaining pin
26 guide pin
27 locking element
28 upper ring
29 oblong through hole
30 closing ring
31 flexible part
32 return spring
33 retention circlip
34 opening
35 lug
36 ramp
37 notched washer
38 first ramp spring

39 second ramp spring
40 notch of flexible part
41 lever
42 contact surface
43 base

The invention claimed is:

1. A secure locking and unlocking system, comprising:

a plug body, cylindrical in shape, comprising a threaded part on its outer wall;

a locking ring with a thread on its inner surface and configured to be mounted on the plug body, the locking ring comprising at least one hole extending along a line parallel to a longitudinal axis of the locking ring and opening onto a locking surface, wherein the locking ring is configured to lock the secure locking and unlocking system in one direction of a rotation of the locking ring and unlock the secure locking and unlocking system in other direction of the rotation of the locking ring;

a notched washer with one face positioned on the locking surface of the locking ring;

a holding pin to lock a position of a locking element and insertable in the hole extending beyond the locking surface;

an upper ring mounted on the locking ring, the upper ring comprising a contact surface configured to press against other face of the notched washer, and a lever configured to unlock the locking element in a direction of the rotation of the locking ring;

wherein the locking element is mounted on the holding pin to lock the position of the locking element, the locking element comprises a flexible part configured to fit between two notches of the notched washer;

wherein the locking ring comprises a ramp-shaped groove with a linear part, a rising ramp and a descending ramp;

a ramp spring configured so that a locking or unlocking movement of the upper ring is mobile and the locking ring is fixed; and wherein the upper ring comprises a hole in which a lug is placed, and an end of the lug cooperates with the ramp-shaped groove of the locking ring that guides the upper ring in relation to the locking ring.

2. The secure locking and unlocking system according to claim 1, wherein a stiffness of the ramp spring applies a predetermined limit value for locking or unlocking the locking ring.

3. The secure locking and unlocking system according to claim 2, wherein the predetermined limit value is above 0.2 Nm.

4. The secure locking and unlocking system according to claim 1, wherein the locking ring comprises a first visual mark; wherein the upper ring comprises a second visual mark; and wherein the secure locking and unlocking system is locked when the first visual mark and second visual mark are lined up.

5. The secure locking and unlocking system according to claim 1, further comprising a return spring positioned in a recess of the upper ring between a guide pin and a support of the recess of the upper ring, the return spring being positioned in a circular manner in relation to the upper ring.

6. The secure locking and unlocking system according to claim 4, further comprising a closing ring held in place by a retaining circlip inside the upper ring.

7. The secure locking and unlocking system according to claim 1, wherein each notch of the notched washer has a vertical slope to block unlocking and an oblique slope to obtain a ratchet sound upon locking.

8. The secure locking and unlocking system according to claim 1, wherein the upper ring comprises an opening to receive the plug body.

9. The secure locking and unlocking system according to claim 1, wherein the locking element is a latch.

* * * * *